United States Patent [19]

Stiles

[11] Patent Number: 4,599,758

[45] Date of Patent: Jul. 15, 1986

[54] PLIABLE CONTAINER OPENING AND EMPTYING DEVICE

[76] Inventor: Robert G. Stiles, 2003 Bayview Heights Dr., Sp. 194, San Diego, Calif. 92106

[21] Appl. No.: 683,626

[22] Filed: Dec. 19, 1984

Related U.S. Application Data

[63] Continuation-in-part of Ser. No. 532,798, Sep. 16, 1983, abandoned.

[51] Int. Cl.[4] ..... B65D 35/28

[52] U.S. Cl. ..... 7/158; 7/170; 7/156; 30/2; 30/123; 222/103; 222/82

[58] Field of Search ..... 222/103, 95, 82; 7/110, 7/158, 170, 151, 156; 30/2, 123, 124; 81/488; 53/384; 414/412

[56] References Cited

U.S. PATENT DOCUMENTS

| | | | |
|---|---|---|---|
| 1,983,462 | 12/1934 | Johnson . | |
| 2,206,985 | 7/1940 | Voght . | |
| 2,881,520 | 4/1959 | Mito | 30/2 |
| 2,903,161 | 9/1959 | Stahmer | 222/103 |
| 3,142,074 | 7/1964 | Reich | 7/135 |
| 3,194,452 | 7/1965 | Sanderford . | |
| 3,774,251 | 11/1973 | Pellman | 7/132 |
| 3,993,220 | 11/1976 | Troy | 222/95 |
| 4,159,787 | 7/1979 | Wright | 222/103 |
| 4,514,902 | 5/1985 | Stewart | 30/2 |

FOREIGN PATENT DOCUMENTS

| | | | |
|---|---|---|---|
| 506861 | 12/1954 | Italy | 222/103 |

*Primary Examiner*—Roscoe V. Parker

*Attorney, Agent, or Firm*—Brown, Martin & Haller

[57] ABSTRACT

In a first embodiment, a pair of cylindrical rods are held in closely spaced parallel relationship by support members mounted in the ends of the rods. The rods have confronting surfaces throughout their length. Pairs of overlapping cutting blades are mounted in the rods and between the confronting surfaces. A container is opened by being inserted between the confronting surfaces and drawn against the blades. When opened, the end of the container opposite the opening is then inserted between the rods and drawn between the confronting surfaces to empty the contents by pressing the opposite sides of the container together. In a second embodiment a flanged slot formed in a flat holder provides the confronting surfaces for emptying the container. Cutting blades mounted in the handle in way of the slot are used to cut the container open.

7 Claims, 11 Drawing Figures

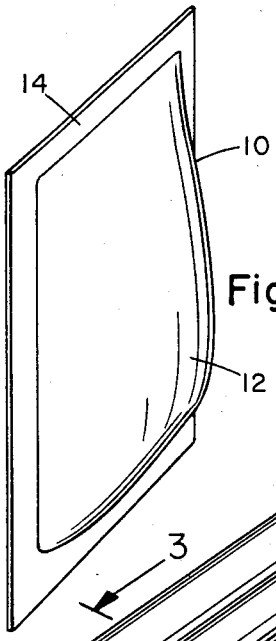
Fig. 1
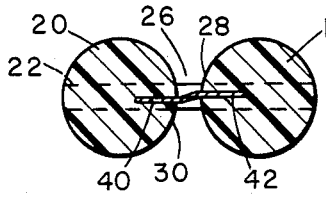
Fig. 3
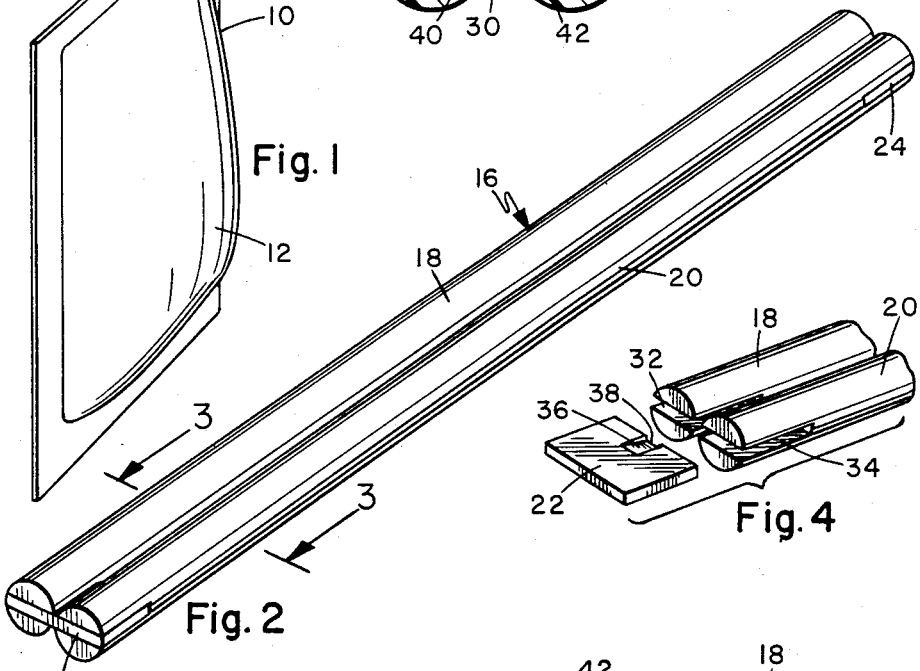
Fig. 2
Fig. 4
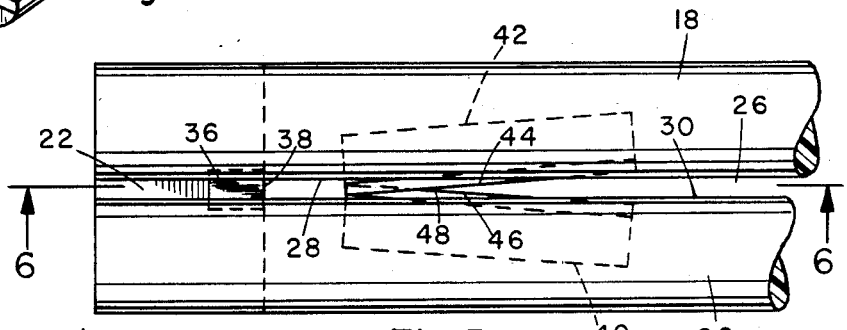
Fig. 5
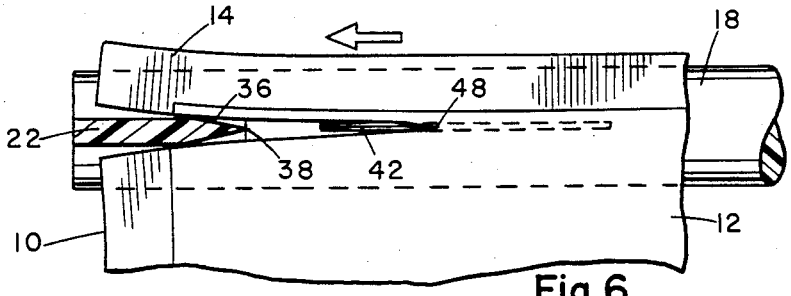
Fig. 6

PLIABLE CONTAINER OPENING AND EMPTYING DEVICE

REFERENCE TO RELATED APPLICATIONS

This application is a continuation in part of my copending application Ser. No. 532,798, filed Sept. 16, 1983 and now abandoned.

BACKGROUND OF THE INVENTION

The invention relates to culinary appliances, and more particularly to a device for stripping open and emptying pliable packages containing food items. Packaging methods for such products stress convenience in handling and storage as well as attractiveness. Modern pliable packages have developed and become standardized in size for a variety of products, but particularly for foods or perishable items that may be frozen or otherwise processed to have long shelf life at room temperature by virtue of various processes such as chemical preservation or retorting. Single items or a meal entree are now available in pliable containers formed of plastic and/or multiple layer combinations of plastic and soft metals. Typically, such containers have a center cavity which holds the product. The cavity is peripherally sealed by a thin border section of the container surrounding the cavity. The marginal border provides a ready means for handling the container both in storing them and preparing their contents for consumption. If cooking of the product is required, preparation of the container contents may be accomplished by heating the sealed container or by empting its contents into a cooking utensil. In either case, access to the contents of the cavity may be achieved by cutting open the container and removing its contents. It is highly desirable to have a single device for quickly and efficiently opening and emptying the container cavity to conserve time and effort, avoid loss of contents, and minimize the equipment needed to accomplish the job. Such a device should be compact, safe in use and storage, easily cleaned, and simple and easy to use. Applicant's device meets these and other requirements.

SUMMARY OF THE INVENTION

According to the invention, a device has been devised with which a pliable container may be both cut open and its contents easily extruded.

In a first exemplary embodiment the device comprises a pair of elongated cylindrical rods held in parallel space relationship by support members attached in the ends of the rods. The rods have closely spaced confronting surfaces forming a slot through which an opened container is drawn to empty its contents. Pairs of inclined cutting blades are mounted in and between the rods adjacent to the support members. The cutting blades of each pair overlap and have their cutting edges inclined at a small angle to form jaw-like cutters oriented toward the mid-length of the rods. By this design, the sharp edges of the blades are safely shrouded by the rods, yet readily available to cut open the container when it is inserted between the rods and drawn against either cutting blade pair. The rod support members have wedged shaped sections between the rods in line with the cutting blades to provide a means for cleanly separating the sections of the container as it is being cut.

Investigation to reduce fabrication and assembly complexities and cost have resulted in design changes in the opening and emptying device as exemplified in a second illustrated embodiment of the invention. In this latter modification, a flat holder delining a longitudinal slot is provided. The sides of the slot serve as the confronting surfaces to bear against and empty a cut container when the container is drawn through the slot. A pair of flanges incorporating the slot surfaces for a portion of their length, and extending from the holder serve to guide a container into and through the slot. A cutting blade is mounted in the holder and extends between the slot confronting surfaces adjacent each end of the slot for opening a container positioned in the slot and drawn against the blade cutting edge. Wedges formed in the handle at the ends of the slot act in cooperating with each cutting blade to separate the sections of the container being cut and prevent jamming of the container in the holder during the cutting operation.

The primary advantage of the invention is to provide a new and improved pliable container opening and emptying device which is easily and safely used and stored. The device has a simple and compact design with no moving parts. It is easily cleaned and relatively inexpensive to produce.

These together with other advantages of the device will become more apparent in considering the details of construction and operation of the device as they will be more fully described. Reference will be made to the accompanying drawings wherein like numerals refer to like parts throughout, and in which:

FIG. 1 illustrates a typical pliable sealed food container;

FIG. 2 is a perspective view of one embodiment of the opening and emptying device;

FIG 3 is an enlarged sectional view taken on line 3—3 of FIG. 2;

FIG. 4 is an exploded perspective view of one end of the device of FIG. 2, both ends being similar;

FIG. 5 is an enlarged top plan view of one end of the device of FIG. 2 showing the cutting blades;

FIG. 6 is a sectional view taken on line 6—6 of FIG. 5 illustrating the container cutting action;

FIG. 7 is a perspective view of a second embodiment of the opening and emptying device;

FIG. 8 is an enlarged section view taken on line 8—8 of FIG. 7;

FIG. 9 is an enlarged top plan view of one end of the device of FIG. 7, both ends being similar;

FIG. 10 is a sectional view taken on line 10—10 of FIG. 9; and

FIG. 11 is a sectional view taken on 11—11 of FIG. 10 illustrating the container cutting action.

DETAILED DESCRIPTION OF THE DRAWINGS

Although applicant's invention can be used effectively with a variety of pliable container shapes and sizes, a typical contemporary food container 10 is illustrated in FIG. 1, and will be used for the purposes of the following description.

The container 10 has a storage cavity 12 which holds the stored product. The stock cavity is sealed around its periphery by a thin border section 14. Border section 14 also serves as a means for grasping the container 10 when handling it. The container 10 may be formed of a pliable plastic such as polypropylene, or have a multiple layer construction of plastics and soft metal layers for improved durability and storage characteristics. Such containers vary somewhat in size, but a five by six inch rectangular dimension is typical. The materials from which a container is made are characteristically resistant to wear and abrasion, but are easily opened by use of a cutting instrument such as a knife or scissors.

The contents of cavity 12 may be cooked or chilled before the container is opened, or served directly in or from the container 10. In any case, the convenience of the container is enhanced by providing a device which can both open and extrude the contents of the cavity 12 simply, easily, and safely.

One embodiment 16 of applicant's device is illustrated in FIG. 2. This embodiment comprises two identical elongated cylindrical rods 18 and 20 that are held in spaced parallel relationship by support members 22 and 24 mounted in the ends of the rods, and held in place by a suitable adhesive. The rods and support members of the illustrated embodiment are formed of plastic, but it should be recognized that other materials could be used. The dimensions of the planar support members 22 and 24 are such that when the rods are secured to them an inter-rod slot 26 is established between the confronting surfaces 28 and 30 of the rods (FIG. 3). The inter-rod slot 26 may vary in width, but a spacing of between 1/32 and 1/16 of an inch has been found to be appropriate and sufficient to allow the passage of the marginal border section 14 and the cavity 12 of the container 10 to pass between the rod confronting surfaces 28 and 30 for both opening and emptying the container 10 as will be subsequently described.

The attachment of the rods 18 and 20 to the support members is the same at either end of the rods and therefore only the connection of the support member 22 to the rods 18 and 20 is illustrated in more detail in FIG. 4. The support member 22 has a planar shape with a rectangular cross section, and is sized to fit into the openings 32 and 34 formed in one end of the rods 18 and 20 respectively. The support member 22 is sized to provide a selected distance between the confronting surfaces of the rods 18 and 20 when the exposed surfaces of the support member 22 are flush with surfaces of the rods. Support member 22 has a wedge shaped section 36 formed in it such that the wedged section is positioned in way of the inter-rod slot 26 when the support member 22 is installed in the ends of the rods. The leading edge 38 of the wedge section 36 is oriented toward the mid-length of rods. The function of the wedge section 36 will be subsequently described in connection with the container opening capability of applicant's device 16.

In the embodiment illustrated in FIGS. 2 through 6, the container opening and emptying device 16 is provided with two pairs of cutting blades mounted in the confronting surfaces 28 and 30 of the rods 18 and 20, one pair of blades being positioned adjacent to each of the support members 22 and 24. This design enhances the convenience of the device, but it should be recognized that a single cutting blade, or one pair of such blades would be sufficient for the operation of the device. The installation of the cutting blade pairs and their arrangement are the same at each end of the device 16. As illustrated in FIGS. 3 and 5, a pair of cutting blades 40 and 42 are mounted in the rods 18 and 20 respectively between the confronting surfaces of the rods and spaced from the support member 22. The blades 40 and 42 are held in openings in the rods by suitable adhesive, and are arranged such that the blades overlap and have their cutting edges 40 and 46 oriented toward the mid-length of the rods 18 and 20. The blades have sufficient length and are positioned to provided a gentle slop to the intersection point 48 of the blade cutting edges to facilitate cutting the container 10. The wedge section 36 of the support member 22 is positioned adjacent to but spaced form the blade intersection point 48 to provide for positive separation of the portions of the container 10 when the container is cut by forcing the cut sections apart when they encounter the divergent potions of wedge 36 after being drawn through the cutting blades.

A second embodiment 50 of the invention is illustrated in FIGS. 7 through 11. As depicted in FIGS. 7 and 8, the device 50 includes an elongated flat holder 52 formed of molded plastic. Gripping notches 54 are formed in the edge 56 at both ends of the holder 52 to facilitate handling the device. The holder 52 has central longitudinal slot 58 through which an open container is drawn to be emptied. Flanges 60 and 62 formed in the holder incorporate and extend the confronting internal surfaces 64 and 66 respectively of the slot 58 for a portion of its length and extend outwardly on both sides of the holder 52. As illustrated in FIG. 8 flanges 60 and 62 have a pair of surfaces 68 and 70 respectively which slope outwardly and away from the slot 58. As a result of this construction, the internal surfaces of the flanges 60 and 62 together form a converging passage 72 for guiding a container into and through the slot 58.

Since the construction of the embodiment 50 is similar on either end of the holder 52 further description will be directed to the lower left end of the holder 52 as depicted in FIG. 7. As illustrated in FIGS. 9 and 10, a cutting blade 74 is attached by suitable means in a recess 76 formed in one side of the holder 52. The recess 76 is positioned adjacent to the ends of flanges 60 and 62 and place the blade 74 on the center line of the slot 58 for opening a container in the slot drawn against the blade 74. The blade edge is inclined toward the mid-length of the slot 58 to facilitate the blade cutting action. Blade covers 78 are secured in the recess 76 by suitable means to shield portions of the blade 74 for greater safety.

As depicted in FIGS. 7 and 9, a wedge 80 with a container contacting edge 82 is formed in the holder 52 at the end of the slot 58. The wedge 80 engages sections of the container cut by the blade 74 to effect a clean separation of the sections and prevent their being jammed in the device 50. It is been found that a minimum linear spacing between the cutting edge 84 of the blade 74 and the container contacting edge 82 of the wedge 80 to achieve the latter purpose is three-quarters of an inch.

OPERATION

Use of the container opening and emptying device will be described with reference to FIGS. 7 and 11. To cut open the cavity 12 of the container 10, a border section 14 is inserted through the flanges 60 and 62 and into the slot 58 until a portion of the storage cavity 12 is engagable by the cutting blade 74. The container is then manually drawn against the cutting edge 84 of the blade 74 to make an opening in the storage cavity 12 of the desired length. The wedge 80 of the holder 52 facilitates the separation of the cut portions of the container 10 by forcing them apart as the container is drawn past the blade. After the storage cavity 12 is opened, the end of the cavity opposite the opening is inserted between the flanges 60 and 62 and into the slot 58. The container is then pulled through the slot. The restricted spacing between the slot opposing surface 64 and 66 (FIG. 8) to collapse the cavity 12 emptying the contents of the cavity into a cooking utensil or upon a serving surface.

Having described my invention, I claim:

1. A pliable container opening and emptying device comprising:

an elongated member having a longitudinal slot with confronting surfaces for emptying the content of an open container when the container is drawn between said confronting surfaces;

at least one cutting blade mounted in said member and extending between said confronting surfaces for opening a container by drawing the container against said blade.

2. A pliable container opening and emptying device as recited in claim 1 wherein said member further comprises:

a pair of cylindrical rods; and a connecting means for supporting said rods in parallel closely spaced relationship for forming said slot.

3. A container opening and emptying device as recited in claim 2 wherein said connecting means comprises:

at least one planar member mounted in and between said rods adjacent one of the ends thereof;

a wedge section formed in said planar member and spaced between said rods;

said wedge section having a container engaging edge adjacent to said cutting blade.

4. A pliable container opening and emptying device comprising:

an elongated holder having a longitudinal slot with confronting surfaces for emptying the contents of an open container when the container is drawn between said confronting surfaces;

flange measns incorporating said confronting surfaces for at least a portion of the length thereof for guiding a container through said confronting surfaces; and at least one cutting blade mounted in said holder and extending between said confronting surfaces for opening a container by drawing the container against said blade.

5. A pliable container opening and emptying device as recited in claim 4 wherein said holder includes:

wedge means formed in said holder at the ends of said slot for separating the cut portions of a container.

6. A pliable container opening and emptying device as recited in claim 5 wherein:

said cutting blade is spaced between said flange means and said wedge means.

7. A pliable container opening and emptying device as recited in claim 5 wherein:

said flanges have opposing inclined faces forming a converging passage into said slot.

* * * * *

UNITED STATES PATENT AND TRADEMARK OFFICE

CERTIFICATE OF CORRECTION

PATENT NO. : 4,599,758

DATED : July 15, 1986

INVENTOR(S) : Robert G. Stiles

It is certified that error appears in the above-identified patent and that said Letters Patent is hereby corrected as shown below:

Insert the attached sheet of drawing between the cover page of the patent and column 1 of the patent.

Signed and Sealed this

Thirtieth Day of August, 1988

*Attest:*

DONALD J. QUIGG

*Attesting Officer*

*Commissioner of Patents and Trademarks*

Patent No. 4,599,758 July 15, 1986
Robert G. Stiles
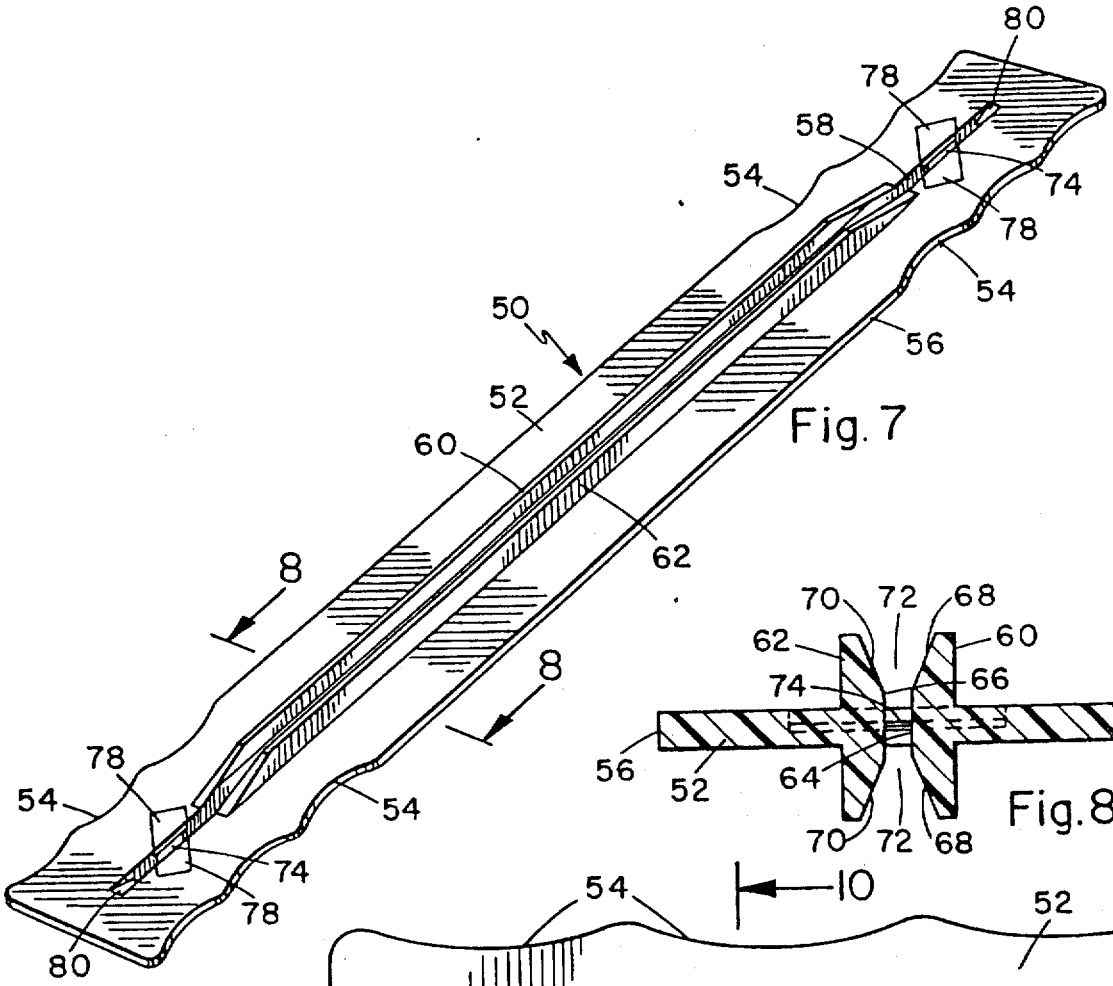
Fig. 7
Fig. 8
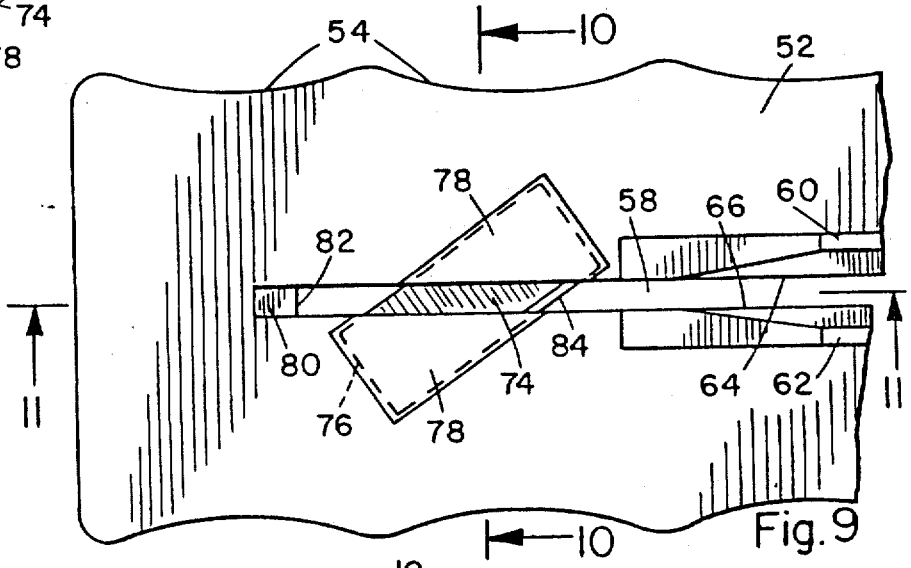
Fig. 9
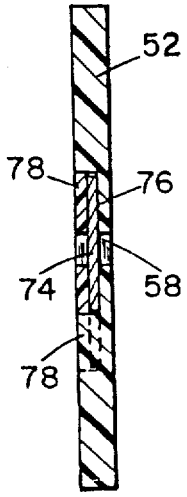
Fig. 10
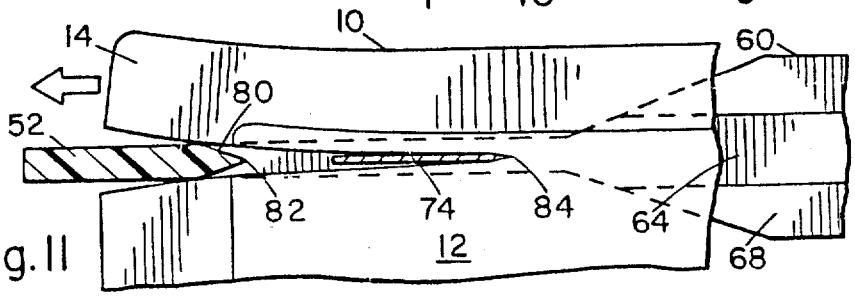
Fig. 11